United States Patent [19]

Clarke, Jr. et al.

[11] Patent Number: 4,591,842

[45] Date of Patent: May 27, 1986

[54] APPARATUS FOR CONTROLLING THE BACKGROUND AND FOREGROUND COLORS DISPLAYED BY RASTER GRAPHIC SYSTEM

[75] Inventors: Charles J. Clarke, Jr., Phoenix; Kevin P. Staggs, Glendale, both of Ariz.

[73] Assignee: Honeywell Inc., Phoenix, Ariz.

[21] Appl. No.: 498,361

[22] Filed: May 26, 1983

[51] Int. Cl.[4] ..... G09G 1/16

[52] U.S. Cl. ..... 340/723; 340/703; 340/747

[58] Field of Search ..... 340/703, 723, 728, 747; 358/133, 260, 261

[56] References Cited

U.S. PATENT DOCUMENTS

| | | | |
|---|---|---|---|
| 3,685,038 | 8/1972 | Flanagan | 340/703 |
| 3,911,418 | 10/1975 | Takeda | 340/703 |
| 4,149,184 | 4/1979 | Giddings et al. | 340/703 |
| 4,180,805 | 12/1979 | Burson | 340/709 |
| 4,420,770 | 12/1983 | Rahman | 340/703 |

*Primary Examiner*—Marshall M. Curtis

*Attorney, Agent, or Firm*—A. A. Sapelli; J. S. Solakian; A. Medved

[57] ABSTRACT

Apparatus for controlling the colors displayed by a raster graphic system. Information stored at each addressable location of a RAM includes a set of behavior bits and a set of control bits. These bits are read out of memory during each memory read cycle. The control bits are stored in a shift register and the behavior bits are applied to an escape code detector and may be stored in a foreground or a background behavior register if enabled by the detector. One control bit is shifted out of the shift register each pixel clock pulse. This control bit determines the register from which the behavior bits are selected to form a color index. The index includes behavior bits from the selected register and the control bit for the pixel being scanned. This index is applied to a color look-up memory which produces color control signals which are applied to D/A converters, the outputs of which control the color and intensity of each pixel of the raster. A certain set of behavior bits, an escape code, causes the detector to inhibit both behavior registers from storing the escape code and enables the background behavior register to store the next set of behavior bits read out of memory. Thereafter the escape code detector enables the foreground register to store behavior bits produced from memory during each memory read cycle until the next escape code is detected.

3 Claims, 1 Drawing Figure

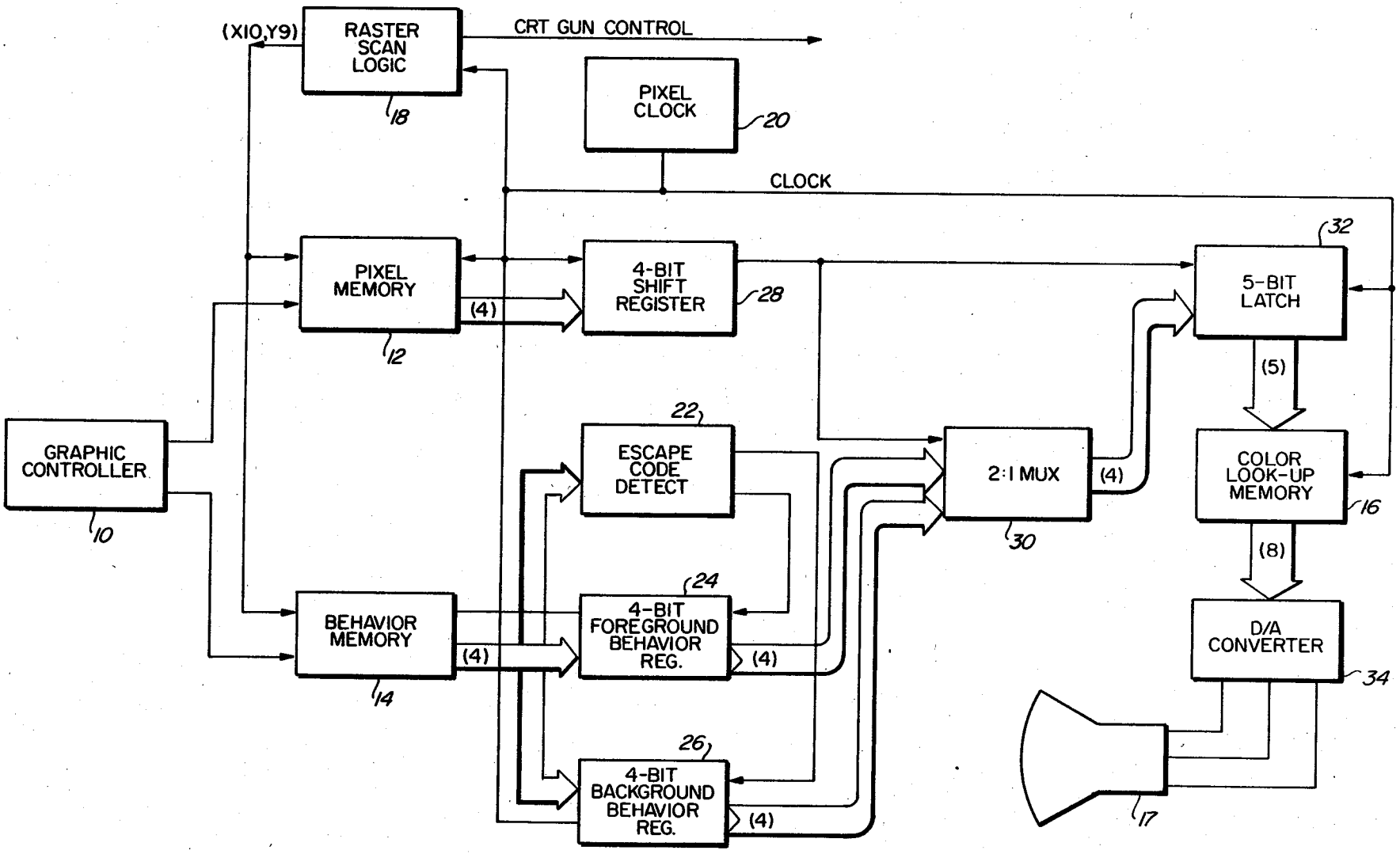
GRAPHIC CONTROLLER
10
PIXEL MEMORY
12
BEHAVIOR MEMORY
14
RASTER SCAN LOGIC
18
(X10,Y9)
CRT GUN CONTROL
PIXEL CLOCK
20
CLOCK
4-BIT SHIFT REGISTER
28
ESCAPE CODE DETECT
22
4-BIT FOREGROUND BEHAVIOR REG.
24
4-BIT BACKGROUND BEHAVIOR REG.
26
(4)
2:1 MUX
30
5-BIT LATCH
32
(5)
COLOR LOOK-UP MEMORY
16
(8)
D/A CONVERTER
34
17

APPARATUS FOR CONTROLLING THE BACKGROUND AND FOREGROUND COLORS DISPLAYED BY RASTER GRAPHIC SYSTEM

BACKGROUND OF THE INVENTION

1. Field of the Invention

This invention is in the field of computer-generated raster graphics and more particularly relates to apparatus in which the memory requirements are reduced without reducing the number of behaviors, or colors, that can be displayed by the cathode ray tube subsystem (CRT) of the system, and in which either the background or the foreground behaviors can be independently changed.

2. Description of the Prior Art

Raster scan CRT displays form a principal communication link between computer users and their hardware/software systems. The basic display device for computer-generated raster graphics is the CRT monitor, which is closely related to the standard television receiver. In order for the full potential of raster graphics to be achieved, such displays require support systems which include large-scale random access memories and digital computational capabilities. As the result of recent developments of large-scale integrated circuits, the price of digital memories has been significantly reduced, and microcomputers are now available with the capability of controlling such displays at affordable prices. As a result, there has been a surge of development in raster graphics. Typically, each PIXEL in a rectangular array of a picture element (PIXEL) of a CRT is assigned a unique address, comprising the X and Y coordinates of each PIXEL in the array. Information to control the display is stored in a random-access memory (RAM) at locations having addresses corresponding to those assigned to the PIXELS. The source of PIXEL control data stored in the RAM is typically a microcomputer located in a graphic controller which will write into the addressable memory locations of the RAM the information necessary to determine the type of display. This frequently includes an address in a color look-up memory, at which location there is stored binary color control signals to control the intensity of the color of each pixel of an array. The horizontal and vertical sweeps of the raster scan are digitized to produce addresses of the PIXELS, which addresses are applied to the memory in which the controller has previously written information determinative of the display; i.e., the color and intensity of the addressed PIXEL as it is scanned. As stated above, this information can be an address in a color look-up memory. The digital color control signals are read out of the addressed locations in the color look-up memory. The digital color control signals are converted to analog signals and applied to the three color guns of the typical CRT to control the intensity and color of each PIXEL as it is scanned.

A well-known technique for controlling the displays of such a system is to have a PIXEL memory containing a PIXEL image of the display in each addressable location of which is stored a background/foreground control bit and a corresponding behavior memory that describes the color, or behavior, of each PIXEL. The size of the memory required is equal to the number of PIXELS times the sum of the background/foreground bits plus the number of behavior bits, typically four per PIXEL.

There is a need in color graphic systems to reduce the memory requirements of such systems without a commensurate degradation in the versatility of colors displayed by each PIXEL.

SUMMARY OF THE INVENTION

The present invention provides apparatus which includes a random-access memory in which is stored four control bits and four behavior bits at an addressable location corresponding to a pixel address of one of a set of four adjacent PIXELS. Addressing four adjacent PIXELS at a time takes advantage of the fact in most displays, text, bar charts, trends, etc., that four such PIXELS will have the same background or foreground color. Thus, the memory size required is two bits per PIXEL in a system utilizing a five-bit behavior signal compared to prior art system which requires five bits of memory per PIXEL.

The sweep signals are digitized to form PIXEL addresses which are used to address the random-access memory with the address of one of four of the PIXELS being used to address the memory. A PIXEL clock produces PIXEL clock pulses, one as each PIXEL is scanned. During each memory read cycle, the four background/foreground control bits stored at the addressed location of the random-access memory are written into a shift register which will read out, or produce, one control bit for each pixel clock pulse produced by the PIXEL clock. Foreground and background register means are provided into which can be stored four behavior bits produced by the memory means during each read cycle. A detector for a unique set of behavior bits, an escape control set, or escape code, inhibits the escape code from being written into either the foreground or background behavior registers. Whenever the escape code detector detects that the four behavior bits stored at an addressed location form the escape code, the four behavior bits read out during the next memory read cycle are stored into the background behavior register. It should be noted that only the set of behavior bits immediately after the escape code has been detected is written into the background register. All other sets of behavior bits read out of the memory are written into and stored by the foreground register. The background-/foreground control bits, as they are read out of the shift register, one control bit per PIXEL clock pulse, are applied to a 2:1 multiplexer, to which are also applied the signals stored in the foreground and background behavior registers. Depending on the value of the background/foreground control bit read out of the shift register and applied to the multiplexer, either the behavior bits stored in the foreground behavior register or the background behavior register and the control bit are applied to a five-bit latch to form the color index, or address. The color index is then applied to the color look-up memory and eight bits of color signals, for example, stored at the addressed location in the color look-up memory are applied to D/A converters to produce the red, green and blue color control signals which are applied to the color guns of the CRT of the system.

It is, therefore, an object of this invention to provide an improved method for controlling the colors of a raster graphic system in which the memory requirements are decreased without decreasing the number of behaviors the system can display.

It is another object of this invention to provide an improved method for controlling the colors of a raster graphic system in which the background or foreground behaviors can be independently changed.

BRIEF DESCRIPTION OF THE DRAWING

Other objects, features and advantages of the invention will be readily apparent from the following description of a preferred embodiment thereof, taken in conjunction with the accompanying drawing, in which:

The sole FIGURE is a schematic block diagram of the apparatus for controlling the colors displayed by a raster graphic system.

DETAILED DESCRIPTION OF THE INVENTION

In the sole FIGURE, there is illustrated apparatus for controlling images displayed by a computer-generated, or controlled, raster graphic system. Graphic controller 10 has the capability of writing into random-access PIXEL memory 12 and behavior memory 14, as well as color look-up memory 16, binary digital information that is used to control the intensity and color of each PIXEL of a conventional color cathode ray tube 17. Raster scan logic 18 of tube 17 includes conventional digitizing circuits to digitize the horizontal and vertical sweep signals of the raster scan of tube 17 so that for each PIXEL on the face of tube 17 there is a number, or address. To uniquely identify each of the 640 pixels in a horizontal line and in the 480 vertical lines of a standard cathode ray tube raster requires a 19-bit address, with the X component comprising 10 bits and the Y component 9 bits. The X address corresponds to the ordinate and the Y address to the abscissa of PIXELS of the substantially rectangular raster. While in the sole figure, PIXEL memory 12 and behavior memory 14, as well as the color look-up memory 16, are indicated as being separate, they may be combined, or located, in a single conventional random-access memory. PIXEL clock 20 produces a clock pulse each time that a PIXEL in the raster is scanned. The output of the PIXEL clock 20 is applied to memories 12, 14 and 16, as well as to the control circuitry of this invention, as will be described below, to synchronize their operation. To minimize the size of the memory subsystem and to permit the use of slower memories, a single address for a set of adjacent PIXELS, such as four PIXELS lying in a horizontal scan line, is used as a memory address, or, stated another way, by addressing four PIXELS at a time the two lower order bits of the address of each individual PIXEL are ignored, or, more accurately, they are deemed to be logical zeros. PIXEL memory 12 will store at each of its addressable memory locations four background/foreground control bits which determine whether the color of the corresponding PIXEL will be a background or a foreground color, as will be described below. The four behavior bits stored at each addressable memory location of memory 14 form part of the address of a memory location of color look-up memory 16. Stored at each addressable memory location of color look-up memory 16 are eight bits, or a byte, of binary color control signals. During each read cycle of the random-access memory subsystem, and particularly of behavior memory 14, four behavior bits are read out of behavior memory 14 and are applied to escape code detector 22, which checks to see if the four behavior bits applied to it have a predetermined value or comprise a predetermined set of behavior bits, such as, for example, all four behavior bits are logical ones, sometimes hereafter referred to as the escape code. If the bits stored in the addressed location of behavior memory 14 are not the escape code, then detector 22 produces a register enable signal that enables register 24 to store the behavior bits read out of behavior memory 14. If the four behavior bits read out of behavior memory 14 constitute the escape code, then the escape code detector will prevent, or inhibit, either register 24 or background behavior register 26 from storing that particular set of behavior bits, the escape code, but will produce a register enable control signal which enables background behavior register 26 to store the set of behavior bits read out of behavior memory 14 during the next read cycle of memory 14. During each read cycle of memories 12 and 14, the background/foreground control bits are stored into shift register 28. The control bits loaded into shift register 28 are shifted out of shift register 28 at the rate of one for each pixel clock pulse, and each control bit when produced as applied to multiplex 30. If the background/foreground control bit is a logical one, for example, multiplexer 30 will apply the four bits stored in foreground behavior register 24 to color index latch 32. If the background/foreground control bit is a zero, multiplexer 30 will apply the four signals stored in the background behavior register 26 to color index latch 32. The background/foreground control bit read out of shift register 28 during each clock period is combined with, or concatenated with, the four behavior bits from multiplexer 30 to form a five-bit color index, or address. These addresses are stored in latch 32 and then applied to the address logic of color look-up memory 16. Typically, at each addressable location of color look-up memory 16, there are stored eight bits, color control signals, which when read out of memory 16 are applied to conventional D/A converters 34. The color control signals are converted by D/A converter 34 into analog signals for controlling the intensity of the red, green and blue color guns of conventional CRT 17. In synchronism with the scanning of each PIXEL of the array, or raster, color look-up memory 16 produces an eight-bit byte of color control signals for the PIXEL being scanned, which byte is applied to D/A converter 34. D/A converter 34 converts six of the eight bits of the color control signals for that PIXEL into three analog signals which control the intensity of the red, green and blue electron beam guns of color cathode ray tube 17. In the preferred embodiment, two bits of each color control signal are applied to a fourth D/A converter, which converts these two bits into a monochrome analog signal that can be used to produce a permanent record of the raster display using conventional equipment, as is well known in the art.

During normal raster scanning, the background/foreground control bit produced by shift register 28 determines if the PIXEL being scanned is to have a foreground or a background color. Multiplexer 30, to which the background/foreground bits are applied, determines which set of behavior bits will be applied to latch 32. The five bits from latch 32 are used as the address of a memory location in color look-up memory 16 in which the color control signals for each PIXEL are stored, and which determine the color each PIXEL displays as it is scanned by the electron beams of CRT 17.

From the foregoing, it is obvious that the apparatus of this invention significantly reduces the memory requirements of color graphic systems without reducing the number of colors displayed, other variables remaining substantially the same. In addition, this invention enables the background and foreground colors to be changed independently of each other.

What is claimed is:

1. Apparatus for controlling the colors displayed by a raster graphic system comprising:

PIXEL clock means for producing PIXEL clock pulses, one clock pulse as each PIXEL is scanned;

raster scan logic means for producing the address of each PIXEL as scanned;

random access memory means to which the addresses of PIXELS produced by the raster scan logic means are applied for producing during each memory read cycle "n" control bits and a set of behavior bits stored at the addressed memory location, the address of the addressed memory location being that of the first of a set of "n" adjacent PIXELS of a given horizontal scan line, a memory read cycle occurring every "n"th clock pulse, where "n" is an integer greater than one;

shift register means into which are loaded the "n" control bits read out of the memory each memory read cycle, said shift register means producing one control bit for each clock pulse produced by the PIXEL clock;

first behavior register means and second behavior register means for storing the behavior bits produced by the memory each memory read cycle;

detection means for examining each set of behavior bits produced during each memory read cycle to detect a predetermined set of behavior bits;

means responsive to said detection means failing to detect that a set of behavior bits examined is said predetermined set for enabling the first behavior register means to store that set of behavior bits, said means responsive to said detection means detecting that a set of behavior bits examined is said predetermined set for inhibiting both behavior register means from storing said predetermined set of behavior bits and for enabling the second behavior register means to store the set of behavior bits produced by the memory means during the next memory read cycle; and circuit means responsive to each control bit produced by the shift register means for selecting the behavior bits stored in either the first or the second behavior register means, said control bit and the set of behavior bits from the selected behavior register means forming an address to a color control memory.

2. Apparatus for controlling the colors displayed by a raster graphic system comprising:

PIXEL clock means for producing PIXEL clock pulses, one clock pulse as each PIXEL is scanned;

raster scan logic means for producing the address of each PIXEL as scanned;

random access memory means to which the addresses of PIXELS produced by the raster scan logic means are applied for producing during each memory read cycle four control bits and a set of behavior bits said bits being stored at the addressed memory location, the address of which is that of the first of a set of four adjacent PIXELS of a given horizontal scan line, a memory read cycle occurring every fourth clock pulse;

shift register means into which are stored the four control bits read out of the memory means each memory read cycle, said shift register means producing one control bit for each clock pulse produced by the PIXEL clock;

foreground behavior register means and background behavior register means for storing the behavior bits produced by the memory means each memory read cycle;

escape code detection means for examining each set of behavior bits produced during each memory read cycle to detect a set having a predetermined value;

means responsive to said escape code detection means failing to detect that a set of behavior bits examined has said predetermined value for enabling the foreground register means to store that set, said means responsive to said escape code detection means detecting that a set of behavior bits examined has the predetermined value for inhibiting both behavior registers from storing the set of behavior bits having the predetermined value and for enabling the background behavior register means to store the next set of behavior bits produced by the memory means; and circuit means responsive to each control bit produced by the shift register means for selecting the behavior bits stored in either the foreground or the background behavior register means, said control bit and the set of behavior bits from the selected behavior register means forming an address to a color control memory.

3. Apparatus as defined in claim 1 in which n=4.

* * * * *